US009964349B2

(12) United States Patent
Cho et al.

(10) Patent No.: US 9,964,349 B2
(45) Date of Patent: May 8, 2018

(54) REFRIGERATOR

(71) Applicant: SAMSUNG ELECTRONICS CO., LTD., Suwon (KR)

(72) Inventors: Myung-Hoon Cho, Seoul (KR); Young-Ki Kim, Suwon (KR); Jung-Woo Kim, Seoul (KR); Sung-Yun Jung, Suwon (KR); Won-Seop Choi, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 192 days.

(21) Appl. No.: 14/886,709

(22) Filed: Oct. 19, 2015

(65) Prior Publication Data

US 2016/0273823 A1 Sep. 22, 2016

(30) Foreign Application Priority Data

Mar. 20, 2015 (KR) ..... 10-2015-0039269

(51) Int. Cl.
*F25D 17/08* (2006.01)
*F25D 17/06* (2006.01)

(52) U.S. Cl.
CPC ..... *F25D 17/067* (2013.01); *F25D 17/065* (2013.01); *F25D 2317/063* (2013.01); *F25D 2317/067* (2013.01); *F25D 2317/0682* (2013.01)

(58) Field of Classification Search
CPC ..... F25D 17/065; F25D 17/067; F25D 2317/063; F25D 2317/067; F25D 2317/0682; F25D 2700/121; F25D 17/045; F25D 17/08; F25C 5/005
See application file for complete search history.

(56) References Cited

U.S. PATENT DOCUMENTS 5,816,068 A * 10/1998 Oh ..... F25D 17/065 62/407
5,992,164 A * 11/1999 Kim ..... F25D 17/045 62/186
6,381,982 B1 * 5/2002 Kim ..... F25D 17/065 62/407
6,550,268 B2 * 4/2003 Lee ..... F25D 17/045 62/407
6,564,566 B2 * 5/2003 Kim ..... F25D 17/065 62/225

(Continued)

*Primary Examiner* — Frantz Jules
*Assistant Examiner* — Martha Tadesse
(74) *Attorney, Agent, or Firm* — Staas & Halsey LLP

(57) ABSTRACT

Provided is a refrigerator including: a body; a first storage compartment and a second storage compartment; a cold air generating unit; and a duct unit installed in front of the evaporator in the first storage compartment and including a first flow path on which the cold air is moved into the first storage compartment, a second flow path on which the cold air is moved into the second storage compartment, a first blower fan sending the cold air to the first flow path, a second blower fan sending the cold air to the second flow path, and a guide duct that partitions off the second flow path, wherein at least one cold air flowing portion is formed in the guide duct so that the first flow path and the second flow path are in communication with each other through the at least one cold air flowing portion.

12 Claims, 10 Drawing Sheets

(56) References Cited

U.S. PATENT DOCUMENTS

| | | | | |
|---|---|---|---|---|
| 7,377,124 | B2 * | 5/2008 | Kim | F25D 17/065 62/408 |
| 7,866,182 | B2 * | 1/2011 | Lim | F25D 17/062 62/407 |
| 2008/0202149 | A1 * | 8/2008 | Lim | F25D 17/062 62/407 |
| 2010/0126185 | A1 * | 5/2010 | Cho | F25C 5/005 62/3.63 |
| 2013/0042641 | A1 * | 2/2013 | Ryu | F25D 17/065 62/228.1 |

* cited by examiner

REFRIGERATOR

CROSS-REFERENCE TO RELATED APPLICATION

This application claims the benefit of Korean Patent Application No. 10-2015-0039269, filed on Mar. 20, 2015 in the Korean Intellectual Property Office, the disclosure of which is incorporated herein by reference.

BACKGROUND

1. Field

Embodiments of the present disclosure relate to a refrigerator having an improved cold air flowing structure in which cooling efficiency can be improved.

2. Description of Related Art

In general, a refrigerator supplies cold air generated in an evaporator to a storage compartment, maintains freshness of various food for a long time, and keeps food. The storage compartment of the refrigerator is divided into a refrigerator compartment, temperature of which is maintained at approximately 3° C. and which keeps food refrigerated and a freezer compartment, temperature of which is maintained at approximately −20° C. and which keeps food in a freezer.

The refrigerator repeats a cooling cycle in which a refrigerant is compressed, condensed, expanded and evaporated using a compressor, a condenser, an expansion device, and the evaporator included in the refrigerator. In general, the evaporator is installed in the storage compartment, is heat-exchanged and generates the cold air in the storage compartment.

Evaporators may be installed in the refrigerator compartment and the freezer compartment, respectively, and an evaporator may also be installed in only one of the refrigerator compartment and the freezer compartment. When the evaporator is installed in only one of the refrigerator compartment and the freezer compartment, the refrigerator includes a duct having flow paths on which the cold air generated in the evaporator is moved to the refrigerator compartment and the freezer compartment, respectively, formed in the duct.

When the cold air is moved to the refrigerator compartment and the freezer compartment, respectively, from one evaporator, the cold air is also transferred to only one of the refrigerator compartment and the freezer compartment depending on a driving status of the refrigerator. In this way, when the cold air is moved to only one of the flow paths connected to the refrigerator compartment and the freezer compartment, respectively, due to a pressure difference in the duct, air flows backward on different flow paths such that cooling efficiency may be lowered.

SUMMARY

Therefore, it is an aspect of the present disclosure to provide a refrigerator having an improved structure in which a duct having flow paths on which cold air is moved to a plurality of storage compartments, respectively, formed in the duct has a small volume.

It is another aspect of the present disclosure to provide a refrigerator having an improved structure in which, when only a part of a plurality of blower fans installed in a duct operates, air in the duct can be prevented from flowing backward.

Additional aspects of the disclosure will be set forth in part in the description which follows and, in part, will be obvious from the description, or may be learned by practice of the disclosure.

In accordance with one aspect of the present disclosure, a refrigerator includes: a body; a storage compartment including a first storage compartment and a second storage compartment formed in the body; a cold air generating unit installed in the first storage compartment and including an evaporator for generating cold air; and a duct unit installed in front of the evaporator in the first storage compartment and including a first flow path on which the cold air generated in the evaporator is moved into the first storage compartment, a second flow path on which the cold air is moved into the second storage compartment, a first blower fan sending the cold air to the first flow path, a second blower fan sending the cold air to the second flow path, and a guide duct that partitions off the second flow path, wherein at least one cold air flowing portion may be formed in the guide duct so that the first flow path and the second flow path are in communication with each other through the at least one cold air flowing portion.

The duct unit may include: a first plate, which forms a rear side of the duct unit and in which the first blower fan and the second blower fan are installed; and a second plate coupled to the first plate so that the first flow path and the second flow path are formed.

At least one cold air discharging portion in which the cold air is moved to the first storage compartment, may be formed in the second plate The first blower fan and the second blower fan may be disposed in the first plate so as to be parallel to each other.

The guide duct may be configured to extend from the second blower fan, to be in communication with the second storage compartment, to be coupled to the first plate and to form the second flow path.

When the first blower fan is driven and the second blower fan is not driven, the cold air may be moved to the first storage compartment through the first flow path, and a part of the cold air on the first flow path may be moved to the second flow path through the cold air flowing portion When the second blower fan is driven and the first blower fan is not driven, the cold air may be moved to the second storage compartment through the second flow path, and a part of the cold air on the second flow path may be moved to the first flow path through the cold air flowing portion In accordance with another aspect of the present disclosure, a refrigerator includes: a body; a storage compartment including a first storage compartment and a second storage compartment formed in the body so as to be separated from each other; a cold air generating unit installed in the first storage compartment and including an evaporator for generating cold air; and a duct unit installed in front of the evaporator in the first storage compartment and configured in such a way that the cold air introduced into an internal space of the duct unit is moved to the first storage compartment and the second storage compartment, respectively, wherein the duct unit may include: a plurality of blower fans installed at a rear side of the duct unit and sending the cold air into the internal space of the duct unit; and a guide duct installed in the internal space so that the cold air introduced into the internal space using one of the plurality of blower fans is moved to the second storage compartment, and at least one cold air flowing portion is formed in the guide duct so that an inside and an outside of the guide duct are in communication with each other through the at least one cold air flowing portion.

The duct unit may further include: a first plate, which forms the rear side of the duct unit; and a second plate, which is coupled to the first plate and forms the internal space and in which at least one cold air discharging portion in communication with the first storage compartment is formed.

The plurality of blower fans may be disposed to be parallel to one another.

In accordance with another aspect of the present disclosure, a refrigerator includes: a first storage compartment; a second storage compartment; a cold air generating unit comprising an evaporator to generate cold air; and a duct unit comprising a first channel through which the cold air flows from the evaporator into the first storage compartment, a second channel through which the cold air flows from the evaporator into the second storage compartment, a cold air flowing portion connecting between a section of the first channel and a section of the second channel, such that first channel and the second channel are in communication with each other through the cold air flowing portion, and a first blower fan to drive the cold air from the evaporator into the first channel, such that, upon the driven air having entered the first channel, a larger portion of the driven cold air is moved into the first storage compartment and a smaller portion of the driven cold air is moved into the second channel through the cold air flowing portion. In a further aspect, an end of the first channel that receives the cold air from the evaporator and an end of the second channel that receives the cold air from the evaporator are both in communication with a common space into which the evaporator disposes the cold air.

BRIEF DESCRIPTION OF THE DRAWINGS

These and/or other aspects of the disclosure will become apparent and more readily appreciated from the following description of the embodiments, taken in conjunction with the accompanying drawings of which.

DESCRIPTION OF EMBODIMENTS

Figure 1:
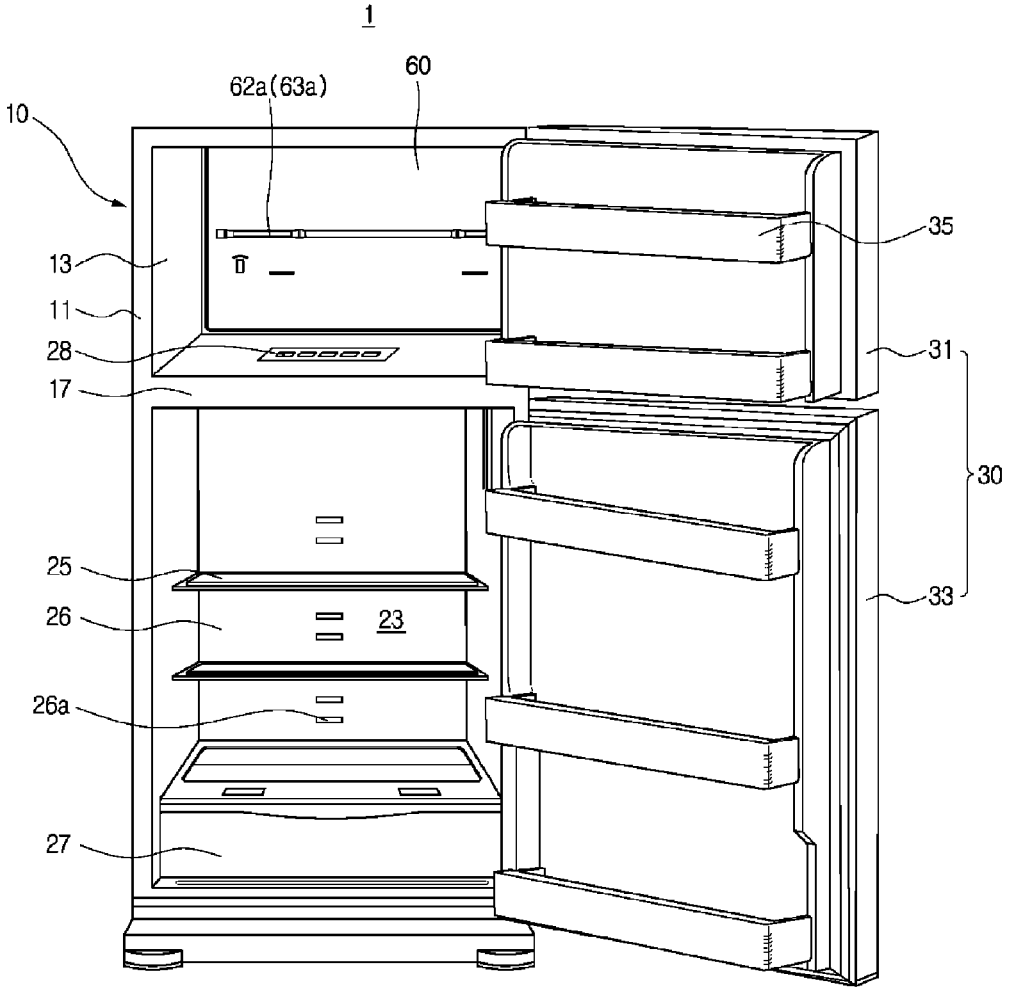
FIG. 1 is a perspective view illustrating an exterior of a refrigerator in accordance with an embodiment of the present disclosure.

Reference will now be made in detail to embodiments of the present disclosure, examples of which are illustrated in the accompanying drawings, wherein like reference numerals refer to like elements throughout.

Hereinafter, exemplary embodiments of the present disclosure will be described in more detail with reference to the accompanying drawings.

Figure 2:
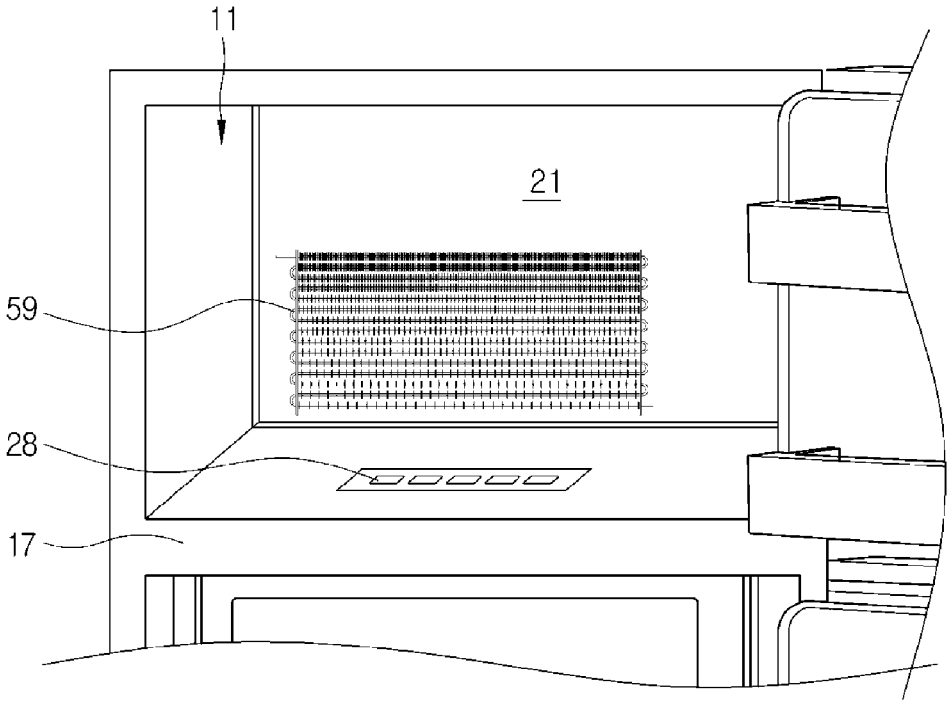
FIG. 2 is a view illustrating a structure of a first storage compartment in which a duct unit of the refrigerator illustrated in FIG. 1 is separated from the first storage compartment.
Figure 3:
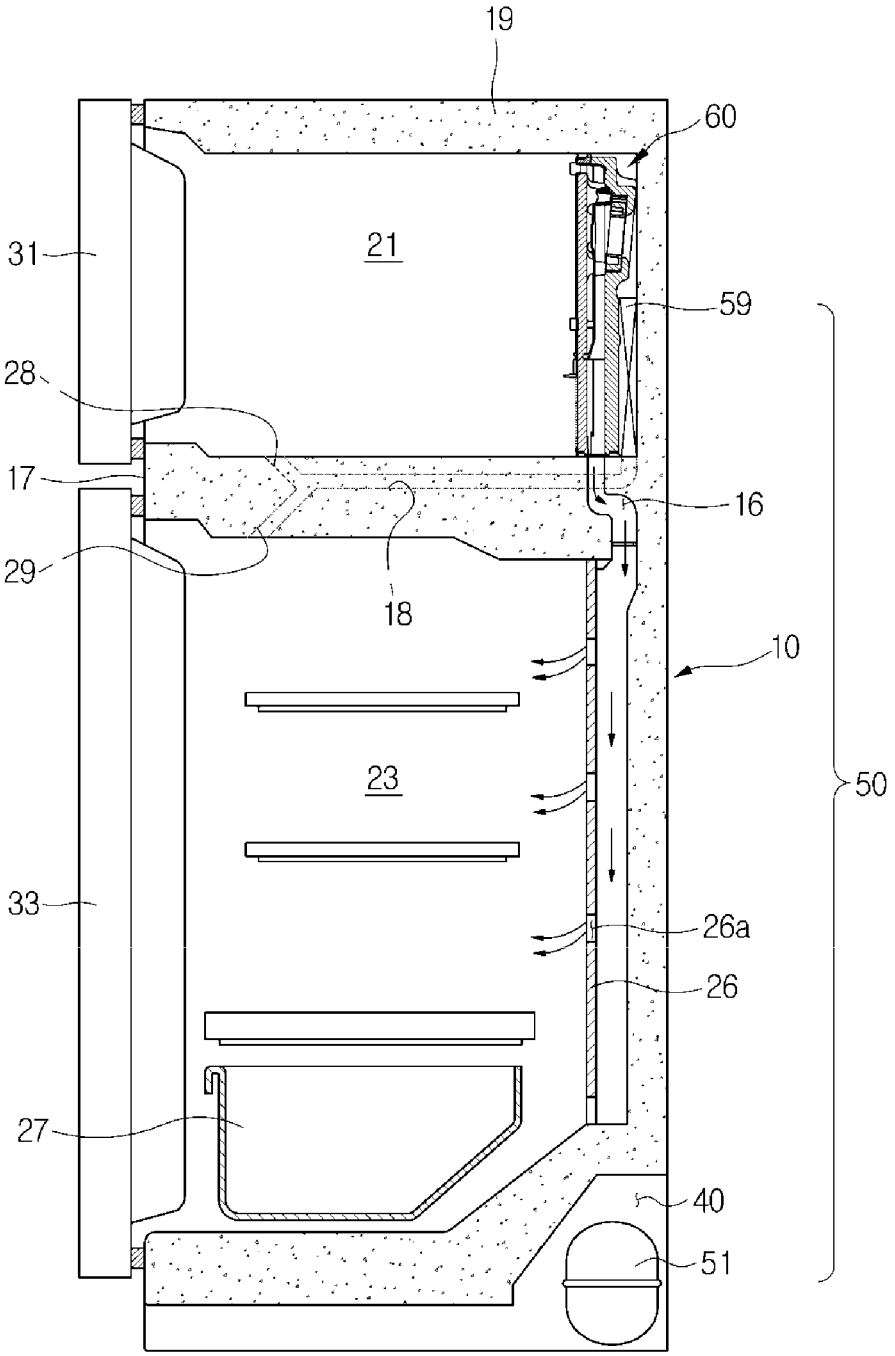
FIG. 3 is a cross-sectional view illustrating a schematic configuration of the refrigerator of FIG. 1.

FIG. 1 is a perspective view illustrating an exterior of a refrigerator in accordance with an embodiment of the present disclosure, and FIG. 2 is a view illustrating a structure of a first storage compartment in which a duct unit of the refrigerator illustrated in FIG. 1 is separated from the first storage compartment, and FIG. 3 is a cross-sectional view illustrating a schematic configuration of the refrigerator of FIG. 1.

Referring to FIGS. 1 through 3, a refrigerator 1 may include a body 10, a storage compartment 20, and a door 30.

The body 10 includes an outer case 11 and an inner case 13. The outer case 11 forms an exterior of the body 10. The outer case 11 may be formed of a metal material having excellent durability and an excellent aesthetic.

The inner case 13 is disposed in an inside of the outer case 11. The inner case 13 forms an exterior of the storage compartment 20. The inner case 13 may be injection-molded as a single body using a plastic material. A space between the inner case 13 and the outer case 11 may be filled with an insulating material 19 so as to prevent cold air in the storage compartment 20 from being discharged.

The storage compartment 20 is disposed so that a front side of the storage compartment 20 through which food is put into or taken out from the storage compartment 20, is opened. According to an embodiment, the storage compartment 20 may be partitioned off into a plurality of storage compartments 20 using a partition wall 17.

The storage compartment 20 may include a first storage compartment 21 and a second storage compartment 23. The first storage compartment 21 and the second storage compartment 23 may be partitioned off using the partition wall 17. As illustrated in FIG. 1, the first storage compartment 21 may be disposed on the partition wall 17, and the second storage compartment 23 may be disposed under the partition wall 17.

The storage compartment 20 may include a refrigerator compartment and a freezer compartment. According to the type of the refrigerator, the first storage compartment 21 may be provided as a freezer compartment, and the second storage compartment 23 may be provided as a refrigerator compartment. The refrigerator 1 according to an exemplary embodiment of the present disclosure may be provided as a top mounted freezer (TMF) type refrigerator in which the first storage compartment 21 provided as the freezer compartment is placed on the second storage compartment 23 provided as the refrigerator compartment. The freezer compartment may be maintained at approximately −20° C., and the refrigerator compartment may be maintained at approximately 3° C. The freezer compartment and the refrigerator compartment may be insulated from each other using the partition wall 17.

A shelf 25 may be disposed in the storage compartment 20. The shelf 25 is provided to support food stored in the storage compartment 20. A plurality of shelves 25 may be provided in the storage compartment 20. The plurality of shelves 25 may be provided to be attachable/detachable to/from the storage compartment 20.

As illustrated in FIG. 3, a storage container 27 may be provided in the storage compartment 20. The storage container 27 may be provided in the form of a box. The storage container 27 may be provided in such a way that food can be stored in a sealed internal space of the storage container 27.

The storage compartment 20 is opened/closed by the door 30. The door 30 is rotatably coupled to the body 10 so as to open/close the opened front side of the storage compartment 20. The first storage compartment 21 and the second storage compartment 23 are opened/closed by a first door 31 and a second door 33 that are rotatably coupled to the body 10.

A door guard 35 may be disposed in the door 30 so as to accommodate food in a rear side of the door guard 35. A plurality of door guards 35 may be provided.

The refrigerator 1 may further include a machine compartment 40. The machine compartment 40 may be formed in a lower portion of the body 10. In detail, the machine compartment 40 may be formed in rear of the body 10, and a space in which a partial configuration of a cold air generating unit 50 is disposed, may be provided in the machine compartment 40.

The cold air generating unit 50 may include a compressor 51, a condenser (not shown), an expansion valve (not shown), and an evaporator 59 (shown in FIG. 2). A freezing cycle of the cold air generating unit 50 including the compressor 51, the condenser (not shown), the expansion valve (not shown), and the evaporator 59 may be provided. Owing to heat-exchanging that occurs when a refrigerant is circulated along the compressor 51, the condenser (not shown), the expansion valve (not shown) and the evaporator 59, is compressed, condensed, expanded and evaporated, cold air may be generated in the storage compartment 20.

According to an exemplary embodiment of the present disclosure, the refrigerator 1 includes the first storage compartment 21 and the second storage compartment 23, but the evaporator 59 may be installed only in the first storage compartment 21. Thus, the refrigerator 1 may further include a duct unit 60 so as to move the cold air generated in the first storage compartment 21 in which the evaporator 59 is installed, into the first storage compartment 21 and the second storage compartment 23, respectively.

Hereinafter, the duct unit 60 according to an exemplary embodiment of the present disclosure will be described in detail.

Figure 4:
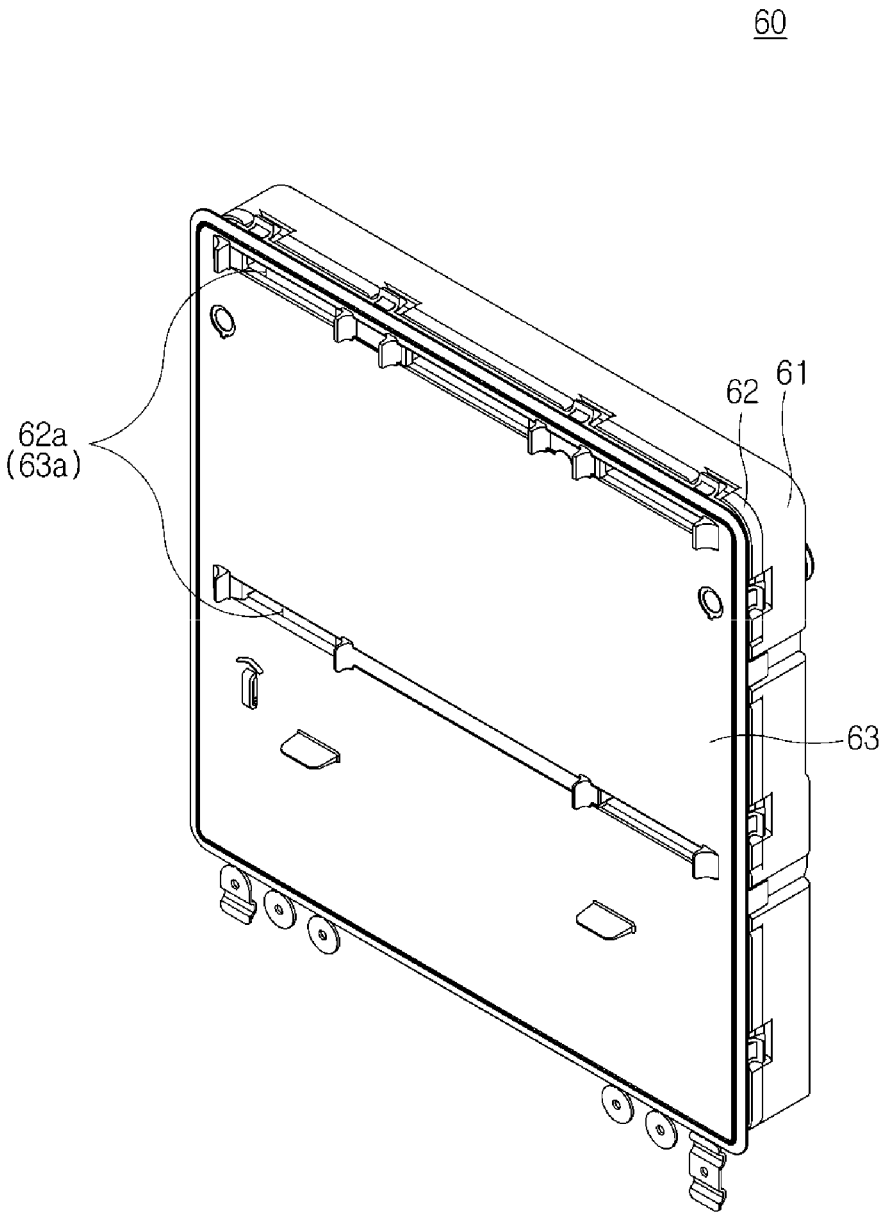
FIG. 4 is a perspective view illustrating the duct unit illustrated in FIG. 1.
Figure 5:
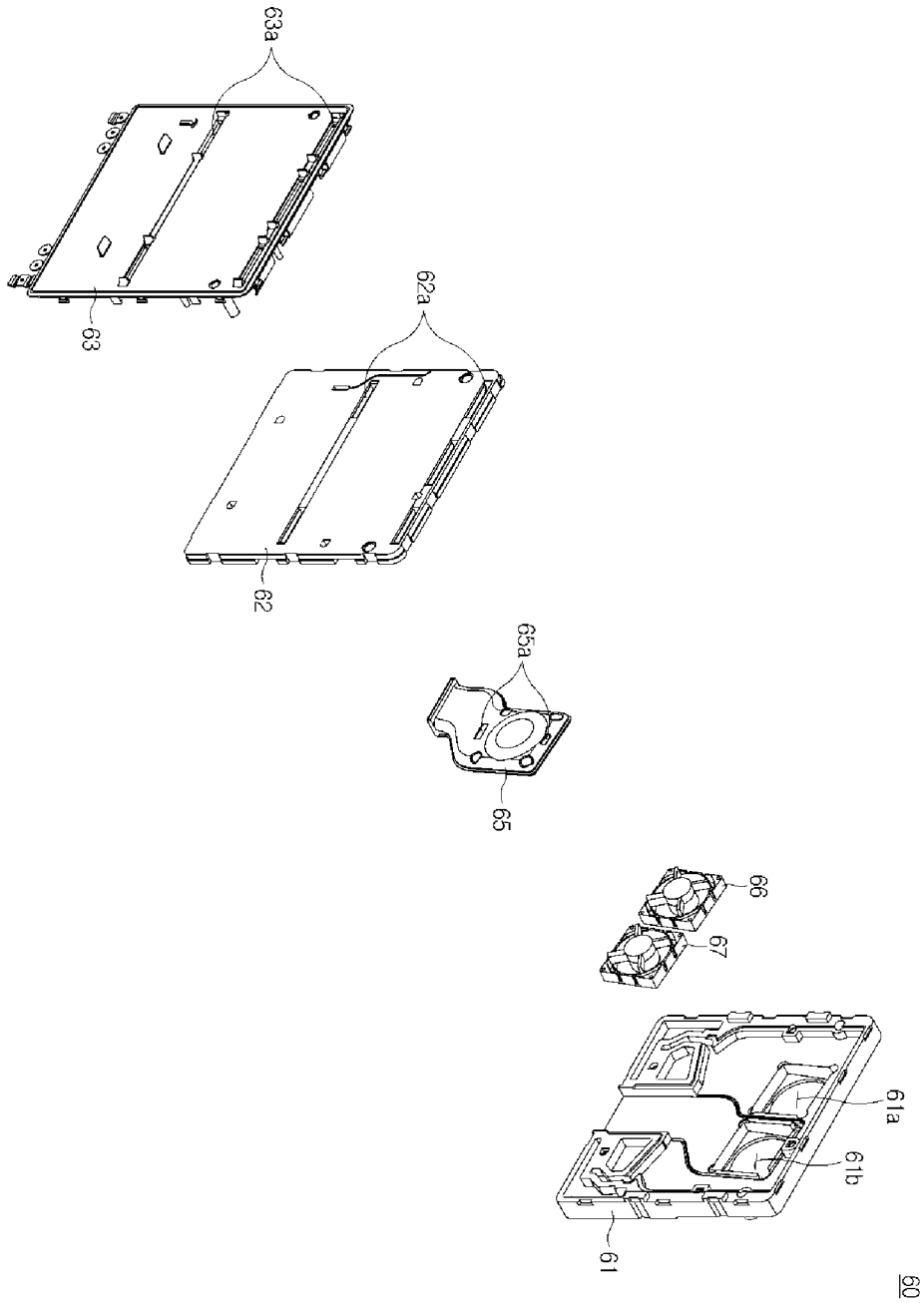
FIG. 5 is an exploded perspective view illustrating a configuration of the duct unit of FIG. 4.
Figure 6:
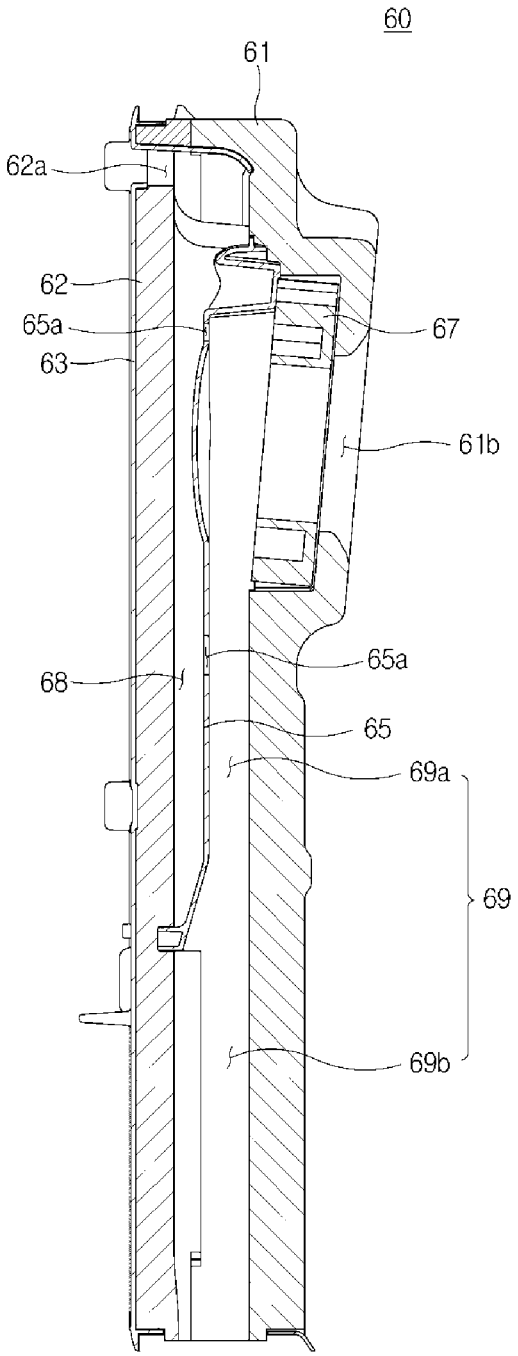
FIG. 6 is a cross-sectional view of the duct unit of FIG. 4.

FIG. 4 is a perspective view illustrating the duct unit illustrated in FIG. 1, and FIG. 5 is an exploded perspective view illustrating a configuration of the duct unit of FIG. 4, and FIG. 6 is a cross-sectional view of the duct unit of FIG. 4.

Referring to FIGS. 3 through 6, the duct unit 60 may be installed in front of the evaporator 59 installed in the first storage compartment 21. The duct unit 60 may partition off the first storage compartment 21 into a space in which the evaporator 59 is installed and the cold air is generated, and a space in which food is kept. The duct unit 60 may be configured to move the cold air generated in the evaporator 59 into the first storage compartment 21 and the second storage compartment 23, respectively.

The duct unit 60 may be configured in such a way that a first flow path 68 and a second flow path 69 are formed in an internal space of the duct unit 60. The first flow path 68 may be formed in such a way that the cold air generated in the evaporator 59 is moved into the first storage compartment 21 on the first flow path 68. The second flow path 69 may be formed in such a way that the cold air generated in the evaporator 59 is moved into the second storage compartment 23 on the second flow path 69. The second flow path 69 may be configured to be in communication with a connection portion 16 that penetrates the partition wall 17 and is connected to the second storage compartment 23, as illustrated in FIG. 3. The cold air may be moved into the second storage compartment 23 through the second flow path 69 and the connection portion 16.

The duct unit 60 may include a first plate 61, a second plate 62, a first blower fan 66, and a second blower fan 67.

The first plate 61 may form a rear side of the duct unit 60. A first introduction portion 61*a* and a second introduction portion 61*b* may be formed in the first plate 61. The first introduction portion 61*a* and the second introduction portion 61*b* may serve as paths on which the cold air generated in the evaporator 59 disposed in rear of the duct unit 60 is moved into the duct unit 60.

The second plate 62 is coupled to the first plate 61 and forms an internal space of the duct unit 60. The second plate 62 may be disposed in front of the first plate 61. At least one cold air discharging portion 62*a* may be formed in the second plate 62. The at least one cold air discharging portion 62*a* may be provided as slit-shaped holes, as illustrated in FIGS. 4 and 5. A plurality of cold air discharging portions 62*a* may be formed. The cold air discharging portions 62*a* may include a plurality of slit holes formed at different heights.

The first blower fan 66 and the second blower fan 67 may be installed at the rear side of the duct unit 60. The first blower fan 66 and the second blower fan 67 may be installed in the first plate 61. The first blower fan 66 and the second blower fan 67 may be installed in the first plate 61 so as to be parallel to each other. The first blower fan 66 may be installed in the first introduction portion 61*a*, and the second blower fan 67 may be installed in the second introduction portion 61*b*. The first blower fan 66 may be disposed to send the cold air to be moved into the first storage compartment 21. The second blower fan 67 may be provided to send the cold air to be moved into the second storage compartment 23. The first blower fan 66 and the second blower fan 67 may be individually driven depending on a status, such as the temperature of the first storage compartment 21 and the temperature of the second storage compartment 23. Thus, it may be that only one evaporator 59 is configured to control the temperature of the first storage compartment 21 and the temperature of the second storage compartment 23, respectively.

The duct unit 60 may further include a guide duct 65. The guide duct 65 may form the second flow path 69 in an internal space of the duct unit 60. The guide duct 65 may be coupled to an inner surface of the first plate 61 and may form the second flow path 69. The guide duct 65 may form the second flow path 69 together with a space 69*a* formed with the inner surface of the first plate 61 and a lower internal space 69*b* of the duct unit 60.

At least one cold air flowing portion 65*a* may be formed in the guide duct 65. The cold air flowing portion 65*a* may be formed in the guide duct 65 so that the first flow path 68 and the second flow path 69 are in communication with each other through the cold air flowing portion 65*a*. The cold air flowing portion 65*a* may be configured to allow an inside and an outside of the guide duct 65 to be in communication with each other so that the first flow path 68 and the second flow path 69 may be in communication with each other. The cold air flowing portion 65*a* may serve as a path on which the cold air moved through the first flow path 68 is moved to the second flow path 69. Also, the cold air flowing portion 65*a* may serve as a path on which the cold air moved through the second flow path 69 is moved to the first flow path 68.

The duct unit 60 may further include a third plate 63. The third plate 63 may be coupled to the front of the second plate 62. The third plate 63 may be provided to have the same area as that of the second plate 62. A cold air discharging portion 63*a* having the same shape as that of the cold air discharging portion 62*a* formed in the second plate 62 may be formed in the third plate 63 in a position corresponding to the cold air discharging portion 62*a*. The third plate 63 may be provided using a different material from that of the first plate 61 or the second plate 62. According to an embodiment of the present disclosure, the first plate 61 or the second plate 62 may be formed of expanded polystyrene, and the third plate 63 may be formed of the same injection-molding material as a material used for forming the inner case 13. The third plate 63 may not be optionally provided.

Through the above-described configuration, the duct unit 60 may move the cold air generated in the evaporator 59 into the first storage compartment 21 and the second storage compartment 23, respectively.

In detail, the cold air generated in the evaporator 59 may be moved into the duct unit 60 through the first introduction portion 61*a* using the first blower fan 66. The cold air may be moved to the first flow path 68 through the first introduction portion 61*a*. The cold air moved to the first flow path 68 may be moved into the first storage compartment 21 through the cold air discharging portion 62*a* formed in the second plate 62.

Also, the cold air generated in the evaporator 59 may be moved into the duct unit 60 through the second introduction portion 61*b* using the second blower fan 67. The cold air may be moved to the second flow path 69 through the second introduction portion 61*b*. The cold air moved to the second flow path 69 may be moved into the second storage compartment 23 through the connection portion 16 formed in the partition wall 17.

The refrigerator 1 according to an embodiment of the present disclosure may be configured to supply the cold air to the first storage compartment 21 and the second storage compartment 23, respectively. Thus, the cold air may be individually supplied to the first storage compartment 21 and the second storage compartment 23 so that the internal temperature of the first storage compartment 21 and the internal temperature of the second storage compartment 23 can be adjusted. Through the above-described configuration, the duct unit 60 may drive the first blower fan 66 and the second blower fan 67 individually and may adjust the cold air moved into the first storage compartment 21 and the second storage compartment 23, respectively.

Also, the first storage compartment 21 may be provided as a freezer compartment or a refrigerator compartment according to a user's selection. In detail, the first blower fan 66 may adjust the cold air moved into the first storage compartment 21 so that the temperature of the first storage compartment 21 can be maintained at the temperature of the refrigerator compartment.

In general, when a plurality of blower fans are installed in a duct unit and cold air is transferred on different flow paths, if only a part of the plurality of blower fans is driven, a pressure difference between an inside of the duct unit and a plurality of introduction portions through which the cold air is introduced into the duct unit, may occur. Thus, air may flow backward on a flow path on which no cold air is introduced, may be discharged to the rear of the duct unit through the introduction portions, and may be introduced into a storage compartment in a state in which the air is not heat-exchanged in an evaporator using the blower fans. Thus, cooling efficiency may be lowered.

Unlike this, the cold air flowing portion 65*a* may be formed in the duct unit 60 according to an embodiment of the present disclosure so as to allow the first flow path 68 and the second flow path 69 to be in communication with each other so that a backflow phenomenon in the duct unit 60 can be prevented.

Figure 7:
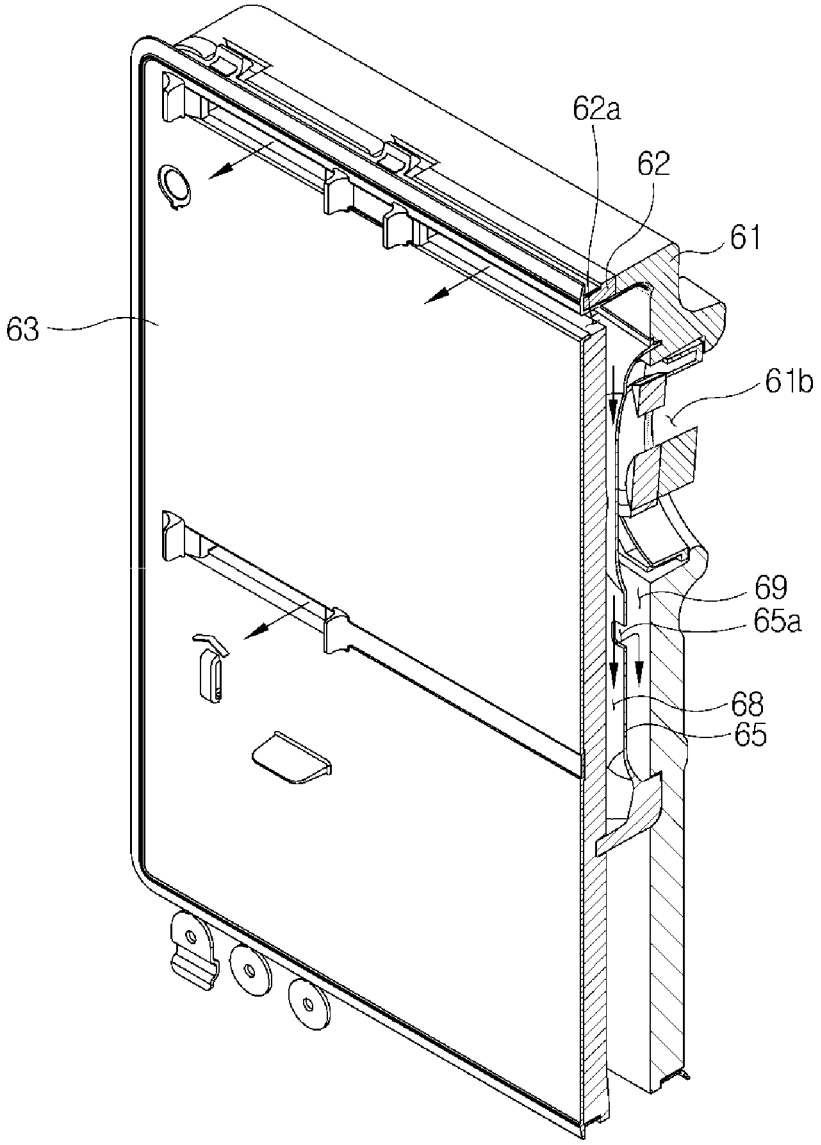
FIGS. 7 and 8 are views illustrating flow of cold air when only a first blower fan of the duct unit of FIG. 4 is driven.
Figure 8:
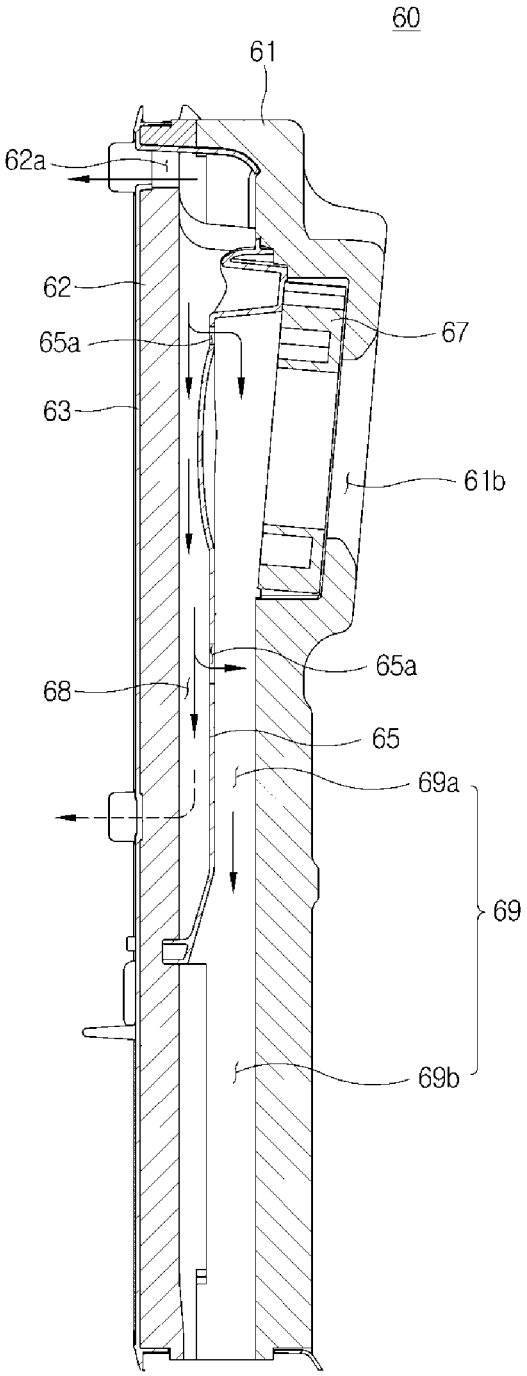

FIGS. 7 and 8 are views illustrating flow of cold air when only a first blower fan of the duct unit of FIG. 4 is driven.

As illustrated in FIGS. 7 and 8, when only the first blower fan 66 of the duct unit 60 is driven, the cold air generated in the evaporator 59 may be introduced into the first flow path 68 through the first introduction portion 61*a*. A most part of the cold air introduced into the first flow path 68 may be moved into the first storage compartment 21 through the cold air discharging portion 62*a*, and a part of the cold air introduced into the first flow path 68 may be introduced into the second flow path 69 through the cold air flowing portion 65*a*. The cold air introduced into the second flow path 69 may be moved downward from the second flow path 69. Thus, a part of cold air is moved from the second flow path 69 to the second storage compartment 23 so that air can be prevented from flowing backward from the second flow path 69 to the rear of the duct unit 60 through the second introduction portion 61*b*.

Figure 9:
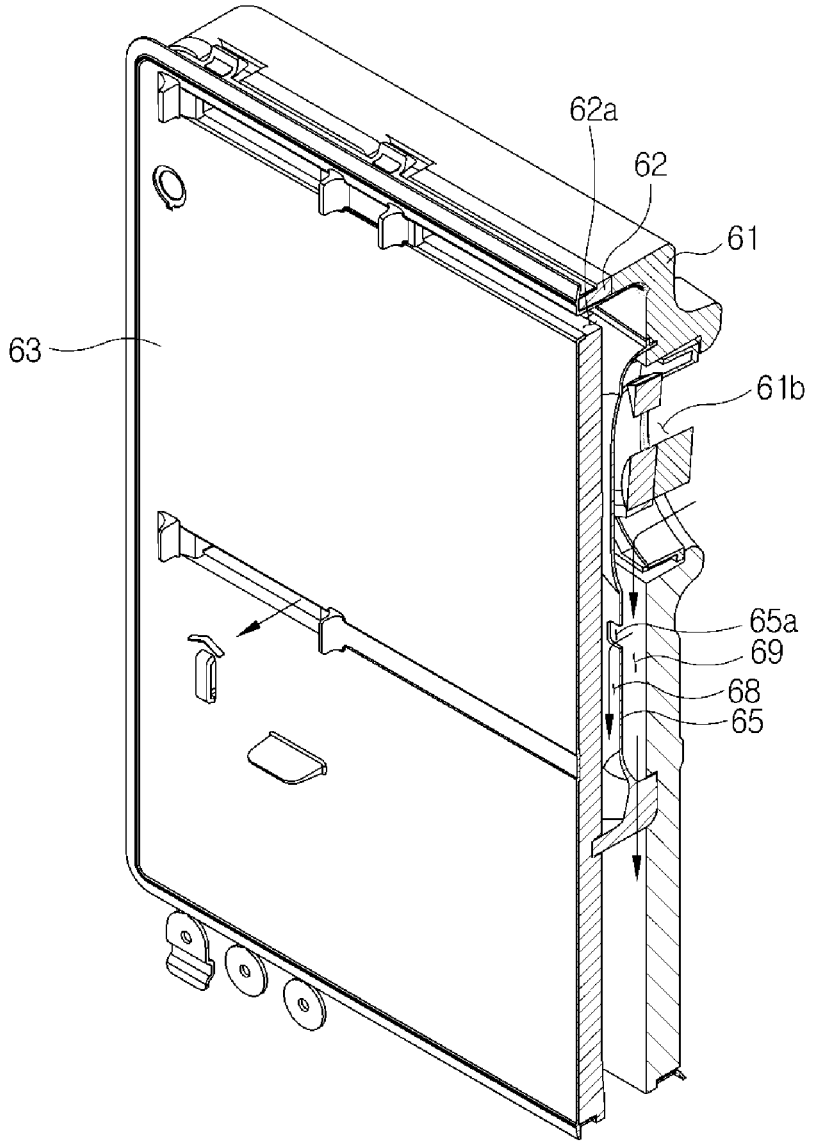
FIGS. 9 and 10 are views illustrating flow of cold air when only a second blower fan of the duct unit of FIG. 4 is driven.
Figure 10:
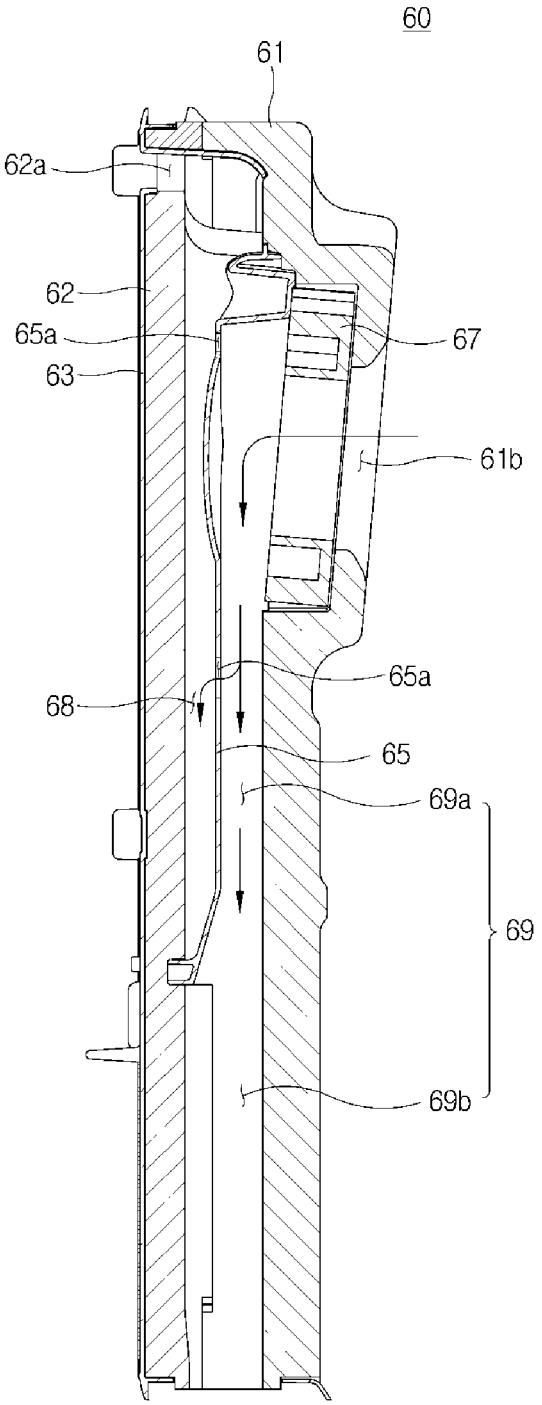

FIGS. 9 and 10 are views illustrating flow of cold air when only a second blower fan of the duct unit of FIG. 4 is driven.

As illustrated in FIGS. 9 and 10, when only the second blower fan 67 of the duct unit 60 is driven, the cold air generated in the evaporator 59 may be introduced into the second flow path 69 through the second introduction portion 61*b*. A most part of the cold air introduced into the second flow path 69 may be moved into the second storage compartment 23 through the connection portion 16, and a part of the cold air introduced into the second flow path 69 may be introduced into the first flow path 68 through the cold air flowing portion 65*a*. The cold air introduced into the first flow path 68 may be moved into the first storage compartment 21 through the cold air discharging portion 62*a*. Thus, a part of cold air is moved from the first flow path 68 to the first storage compartment 21 so that air can be prevented from flowing backward from the first flow path 68 to the rear of the duct unit 60 through the first introduction portion 61*a*.

Air in the first storage compartment 21 may be introduced into a first cold air circulating portion (see 28 of FIG. 3) installed on a bottom surface of the first storage compartment 21 and may be moved to the evaporator 59 through a circulation flow path 18 formed in the partition wall 17. Air in the second storage compartment 23 may be introduced into a second cold air circulating portion (see 29 of FIG. 3) installed on a top surface of the second storage compartment 23 and may be moved to the evaporator 59 through the circulation flow path 18 formed in the partition wall 17. The air moved through the circulation flow path 18 may be heat-exchanged by the evaporator 59 so that cold air can be generated, and the cold air may be moved into the first storage compartment 21 and the second storage compartment 23 through the duct unit 60.

As described above, in a refrigerator according to the one or more of the above exemplary embodiments, a duct having flow paths connected to a plurality of storage compartments, respectively, formed in the duct can be provided to have a small volume.

Even when only one of a plurality of blower fans operates in the duct in which the plurality of blower fans for sending cold air into the plurality of storage compartments are installed, a backflow can be prevented from being forming in the duct.

A backflow phenomenon that may occur in the duct can be prevented so that the cold air can be smoothly supplied to the storage compartments.

The above detailed description is just for the purpose of illustrating the present disclosure. Also, the above-described contents illustrate exemplary embodiments of the present disclosure, and the present disclosure can be used in various different combinations, changes, and environments. That is, the present disclosure can be modified or corrected in the scope of the disclosure disclosed in the present specification, in the equivalent scope to the above-described disclosure and/or in the scope of technology or knowledge in the art. The above-described embodiments describe a best mode for implementing the technical spirit of the present disclosure and can be modified in various ways in detailed application fields and uses of the present disclosure. Thus, the above detailed description is not intended to limit the present disclosure in disclosed embodiments. Also, the accompanying claims should be interpreted to include other embodiments.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:
- a first storage compartment;
- a second storage compartment;
- a cold air generating unit installed in the first storage compartment and comprising an evaporator to generate cold air; and
- a duct unit installed in front of the evaporator in the first storage compartment and comprising
  - a first flow path through which the cold air generated by the evaporator is moved from the evaporator into the first storage compartment,
  - a second flow path through which the cold air generated by the evaporator is moved from the evaporator into the second storage compartment,
  - a first blower fan to send the cold air from the evaporator to the first flow path,
  - a second blower fan to send the cold air from the evaporator to the second flow path, and
  - a guide duct partitioning the second flow path from the first flow path, the guide duct having at least one cold air flowing portion formed therein so that the first flow path and the second flow path are in communication with each other through the at least one cold air flowing portion,
- wherein, when the first blower fan is driven and the second blower fan is not driven, the cold air is moved to the first storage compartment through the first flow path, and a part of the cold air on the first flow path is moved to the second flow path through the cold air flowing portion.

2. The refrigerator of claim 1, wherein the duct unit further comprises:
- a first plate, which forms a rear side of the duct unit and in which the first blower fan and the second blower fan are installed; and
- a second plate coupled to the first plate to form the first flow path and the second flow path.

3. The refrigerator of claim 2, wherein the second plate has at least one cold air discharging portion through which the cold air is moved from the duct unit to the first storage compartment.

4. The refrigerator of claim 2, wherein the first blower fan and the second blower fan are disposed in the first plate so as to be parallel to each other.

5. The refrigerator of claim 2, wherein the guide duct extends from the second blower fan to be coupled to the first plate to form the second flow path.

6. The refrigerator of claim 1, wherein, when the second blower fan is driven and the first blower fan is not driven, the cold air is moved to the second storage compartment through the second flow path, and a part of the cold air on the second flow path is moved to the first flow path through the cold air flowing portion.

7. The refrigerator of claim 1, wherein the first blower fan and the second blower fan are configured to operate separately to maintain the first compartment and the second compartment at different respective temperatures.

8. A refrigerator comprising:
- a first storage compartment;
- a second storage compartment;
- a cold air generating unit comprising an evaporator to generate cold air; and
- a duct unit comprising
  - a first channel through which the cold air flows from the evaporator into the first storage compartment,
  - a second channel through which the cold air flows from the evaporator into the second storage compartment,
  - a cold air flowing portion connecting between a section of the first channel and a section of the second channel, such that first channel and the second channel are in communication with each other through the cold air flowing portion, and
- a first blower fan to drive the cold air from the evaporator into the first channel, such that, upon the cold air having been driven into the first channel by the first blower fan, a first portion of the driven cold air is moved into the first storage compartment and a second portion of the driven cold air is moved into the second channel through the cold air flowing portion, the second portion being a smaller portion than the first portion.

9. The refrigerator of claim 8, wherein
- the evaporator disposes the cold air into a space at a rear side of the duct unit,
- an end of the first channel that receives the cold air from the evaporator and an end of the second channel that receives the cold air from the evaporator are both in communication with the space at the rear side of the duct unit.

10. The refrigerator of claim 8, further comprising
- a second blower fan to drive the cold air from the evaporator into the second channel, such that, upon the cold air having been driven into the second channel by the second blower fan, a first portion of the cold air driven by the second blower fan is moved into the second storage compartment and a second portion of the cold air driven by the second blower fan is moved into the first channel through the cold air flowing portion, the second portion moved into the first channel being a smaller portion than the first portion moved into the second storage component.

11. The refrigerator of claim 10, wherein
- the evaporator disposes the cold air into a space at a rear side of the duct unit, an end of the first channel that receives the cold air from the evaporator and an end of the second channel that receives the cold air from the evaporator are both in communication with the space at the rear side of the duct unit, the first blower fan is disposed between the end of the first channel and the space at the rear side of the duct unit, and the second blower fan is disposed between the end of the second channel and the space at the rear side of the duct unit.

12. The refrigerator of claim 10, wherein the first blower fan and the second blower fan are configured to operate separately to maintain the first compartment and the second compartment at different respective temperatures.

* * * * *